US007458906B2

(12) United States Patent
Choe

(10) Patent No.: US 7,458,906 B2
(45) Date of Patent: Dec. 2, 2008

(54) FLEXIBLE GOLF TEE FOR DRIVING RANGE

(76) Inventor: Il Hang Choe, 7289 University, Dr., Moorpark, CA (US) 93021

( * ) Notice: Subject to any disclaimer, the term of this patent is extended or adjusted under 35 U.S.C. 154(b) by 0 days.

(21) Appl. No.: 11/204,665

(22) Filed: Aug. 16, 2005

(65) Prior Publication Data

US 2005/0277489 A1 Dec. 15, 2005

Related U.S. Application Data

(63) Continuation-in-part of application No. 10/419,377, filed on Apr. 21, 2003, now abandoned.

(60) Provisional application No. 60/375,933, filed on Apr. 27, 2002.

(51) Int. Cl.
*A63B 69/36* (2006.01)

(52) U.S. Cl. ..... 473/387

(58) Field of Classification Search ..... 473/386–403; D21/717–719

See application file for complete search history.

(56) References Cited

U.S. PATENT DOCUMENTS

| | | | | | |
|---|---|---|---|---|---|
| 2,079,387 | A | * | 5/1937 | Sickmiller | 473/398 |
| 2,661,213 | A | * | 12/1953 | Barnard | 473/394 |
| 3,406,977 | A | * | 10/1968 | Voelkerding | 473/398 |
| D306,751 | S | * | 3/1990 | Orton | D21/717 |
| 5,492,323 | A | * | 2/1996 | Lee | 473/387 |
| D420,076 | S | * | 2/2000 | Mezzadra | D21/717 |
| D518,537 | S | * | 4/2006 | Lee et al. | D21/717 |

* cited by examiner

*Primary Examiner*—Steven Wong
(74) *Attorney, Agent, or Firm*—John K. Park; Park Law Firm

(57) ABSTRACT

A flexible golf tee includes a tee portion and a base. The tee portion includes a top disc, and a neck portion. The top disc comprises a concave portion that is adapted to support a golf ball. The neck portion connects the top disc and the base. The base includes a body and a flange attached to the body. The neck portion has a cross-sectional area that is smaller than those of the top disc and the body of the base. The tee is made a material having flexibility allowing the tee portion to return to an upright position after the tee is hit by a golf club, and having strength to stably support a golf ball.

2 Claims, 5 Drawing Sheets

FLEXIBLE GOLF TEE FOR DRIVING RANGE

RELATED APPLICATION

This application is a continuation-in-part application of U.S. patent application Ser. No. 10/419,377, filed on Apr. 21, 2003 now abandoned, the disclosure of which is incorporated by reference as if fully set forth herein. This application is also based on provisional application No. 60/375,933, filed on Apr. 27, 2002.

BACKGROUND OF THE INVENTION

The present invention relates to a flexible golf tee for the driving range. More particularly, this invention relates to a flexible golf tee consisting of two parts and effectively simulates a regular golf tee in appearance and function.

A golf tee is used for supporting a golf ball at an appropriate height above the ground. At a driving range, a player frequently uses a golf tee for practicing. Golf tees by prior art are not suitable for such repetitive practice of golf club swings, since they break, fly out or lie down flat after being hit.

The conventional rubber tee, which is usually adapted to fit a hole of a driving range mat, does not break and return to an upright position after being hit. However, it has a disadvantage that it does not let the eyes of a player stay focused on the ball due to its thickness and shape. When a player has difficulty in focusing her eyes, it becomes difficult to learn how to swing and how to strike a golf ball correctly.

Among tees for golf practicing by prior art, U.S. Pat. No. 5,492,323 to Lee discloses a ball support specially designed for golf practice, which includes a disk-like base and a ball holder received in the base. Both the base and the ball holder are made of rubber. The tee of Lee's patent has disadvantages that since the ball holder is made of rubber, the stiffness of the ball holder is substantially different from an ordinary wooden tee, and it is difficult to place a golf ball on the ball holder in easy and stable manner.

U.S. Pat. No. 5,766,100 to Dilmore discloses a golf tee apparatus, which includes a main support member having a tube, and an insert to be locatable within the tube. The insert is adapted to hold a conventional golf tee. The apparatus of Dilmore's patent has a disadvantages that it requires use of conventional tees and that it is subject to breaking of the tee when the tee is hit by a golf club.

SUMMARY OF THE INVENTION

The present invention contrives to solve the disadvantages of the prior art.

An objective of the invention is to provide a flexible golf tee that is can be used repetitively without breaking or fracture.

Another objective of the invention is to provide a flexible golf tee that is returned to the upright position after being hit by a golf club.

Still another objective of the invention is to provide a flexible golf tee that has the same shape as a regular golf tee used at a golf course.

Still another objective of the invention is to provide a flexible golf tee that has improved durability.

To achieve the above objectives, the present invention provides a flexible golf tee that includes a substantially circular tee portion that is adapted to support a golf ball, and substantially circular base that holds the tee portion. The tee portion includes a top disc, a neck portion, a body portion, a stem portion, and a bottom disc. The top disc includes a concave portion that is adapted to support a golf ball. The neck portion connects the top disc and the body portion. The neck portion has a diameter that is smaller than that of the body portion. The body portion is substantially cylindrical. The stem portion connects the body portion and the bottom disc. The stem portion has a diameter that is smaller than those of the body portion and the bottom disc.

The base includes a hollow body and an annular flange attached to the hollow body. The hollow body is substantially cylindrical. The hollow body includes a first cylindrical portion that receives the body portion of the tee portion, and a second cylindrical portion that receives the stem portion of the tee portion. The inner diameter of the second cylindrical portion is smaller than that of the first cylindrical portion. The base is more flexible than the tee portion.

The diameter of the neck portion becomes gradually smaller starting from the top disc and the body portion, and becomes smallest at a predetermined distance from the body portion.

The second cylindrical portion of the base interlocks with the stem portion of the tee portion between the body portion and the bottom disc of the tee portion so that the tee portion does not collapse into or fly out of the base, when the tee portion is hit by a golf club.

The annular flange of the base includes an annular recess that receives the bottom disc of the tee portion.

The flexible golf tee may further include a reinforcing washer. The reinforcing washer is provided between the base and the bottom disc of the tee portion.

The second cylindrical portion of the base may include two or more annular portions that are spaced from one another.

The tee portion is made of thermoplastic polyurethane elastomer with high impact strength, and the base is made of rubber.

Another embodiment of the present invention provides a flexible golf tee that includes a substantially circular tee portion that is adapted to support a golf ball, and a substantially circular base that is integrally connected to the tee portion. The tee portion includes a top disc, and a neck portion. The top disc includes a concave portion that is adapted to support a golf ball. The neck portion connects the top disc and the base.

The base includes a body and an annular flange attached to the body. The body is substantially cylindrical. The body includes an elongated hole that is provided around the center of the body. The neck portion has a cross-sectional area that is smaller than those of the top disc and the body of the base. The diameter of the neck portion becomes gradually smaller starting from the top disc and the body, wherein the diameter of the neck portion becomes smallest at a predetermined distance from the body.

The flexible golf tee is made a material having flexibility allowing the tee portion to return to an upright position after the flexible golf tee is hit by a golf club, and having strength to stably support a golf ball.

The tee portion may include a through hole that is provided around the center of the tee portion. The through hole of the tee portion is connected to the elongated hole of the base.

The body includes a circular notch that is provided near the position where the body is connected to the neck portion.

The flexible golf tee is made of thermoplastic polyurethane elastomer, wherein the thermoplastic polyurethane elastomer has flexural modulus, which is measured per ASTM D790, ranging from about 9,000 to about 13,000 psi, Durometer Hardness, Shore A (+/−4), which is measured per ASTM D2240, ranging from about 70 A to 110 A, and ultimate tensile strength, which is measured per ASTM D412, ranging from 4500 to 7500 psi.

The advantages of the present invention are: (1) the plastic tee portion of the flexible golf tee is supported by the flexible rubber base, it won't fly out or break, and always automatically returns to its original position; (2) since only the slim tee portion is visible above the driving ranging mat, the flexible golf tee gives a golfer the fairway feeling; (3) golfers can easily concentrate on the golf ball and strike the golf ball with greater effectiveness and consistency; (4) the flexible golf tee is compatible with existing golf equipments so that a user can simply replace old rubber tees with the tee of the present invention, (5) the flexible golf tee is also provided as a single molded piece of plastic, which substantially reduces manufacturing cost; (6) the single piece golf tee has a small size and very portable; and (7) the single piece golf tee requires no assembly or fixing to the ground so can easily be taken to the driving range and removed when practice is complete.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
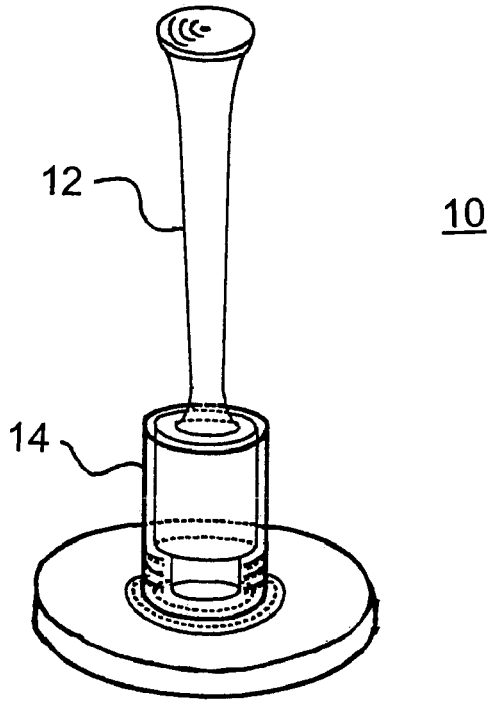
FIG. 1 is a perspective view showing a flexible golf tee for a driving range according to the present invention.
Figure 2:
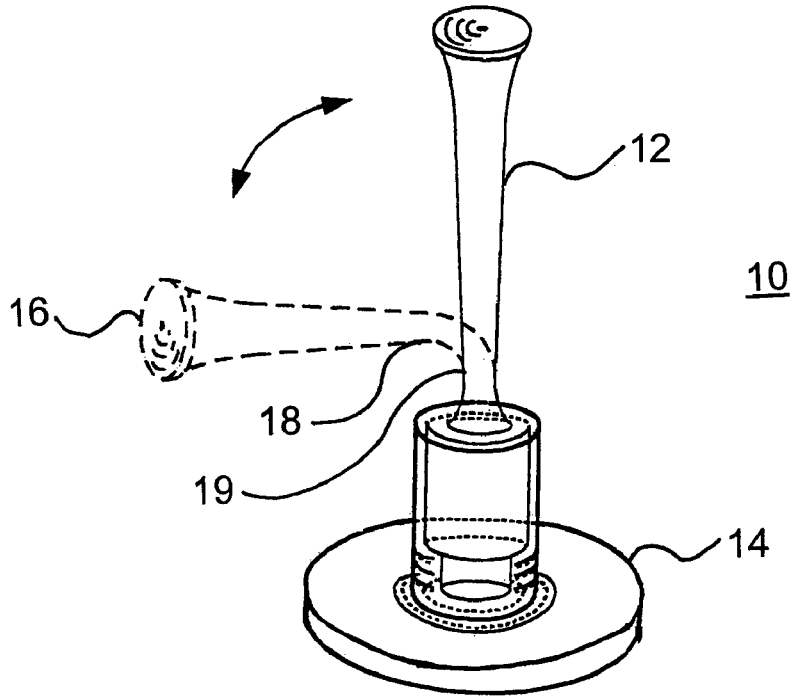
FIG. 2 is a perspective view showing that the tee can be flexibly bent to a bent position and an upright position.
Figure 3:
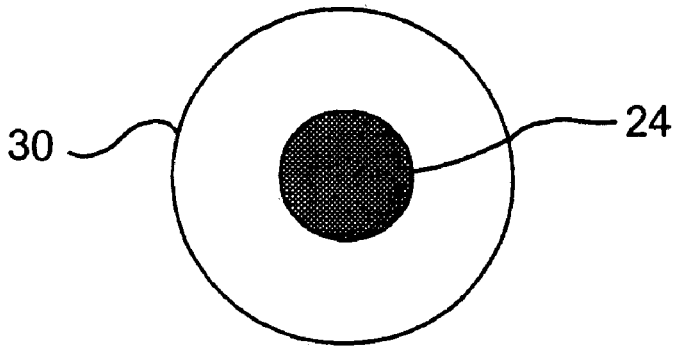
FIG. 3 is a bottom view of the flexible golf tee.

FIGS. 1 ~ 3 show a flexible golf tee 10 of the present invention. The flexible golf tee 10 includes a substantially circular tee portion 12 that is adapted to support a golf ball, and substantially circular base 14 that holds the tee portion 12.

Figure 5:
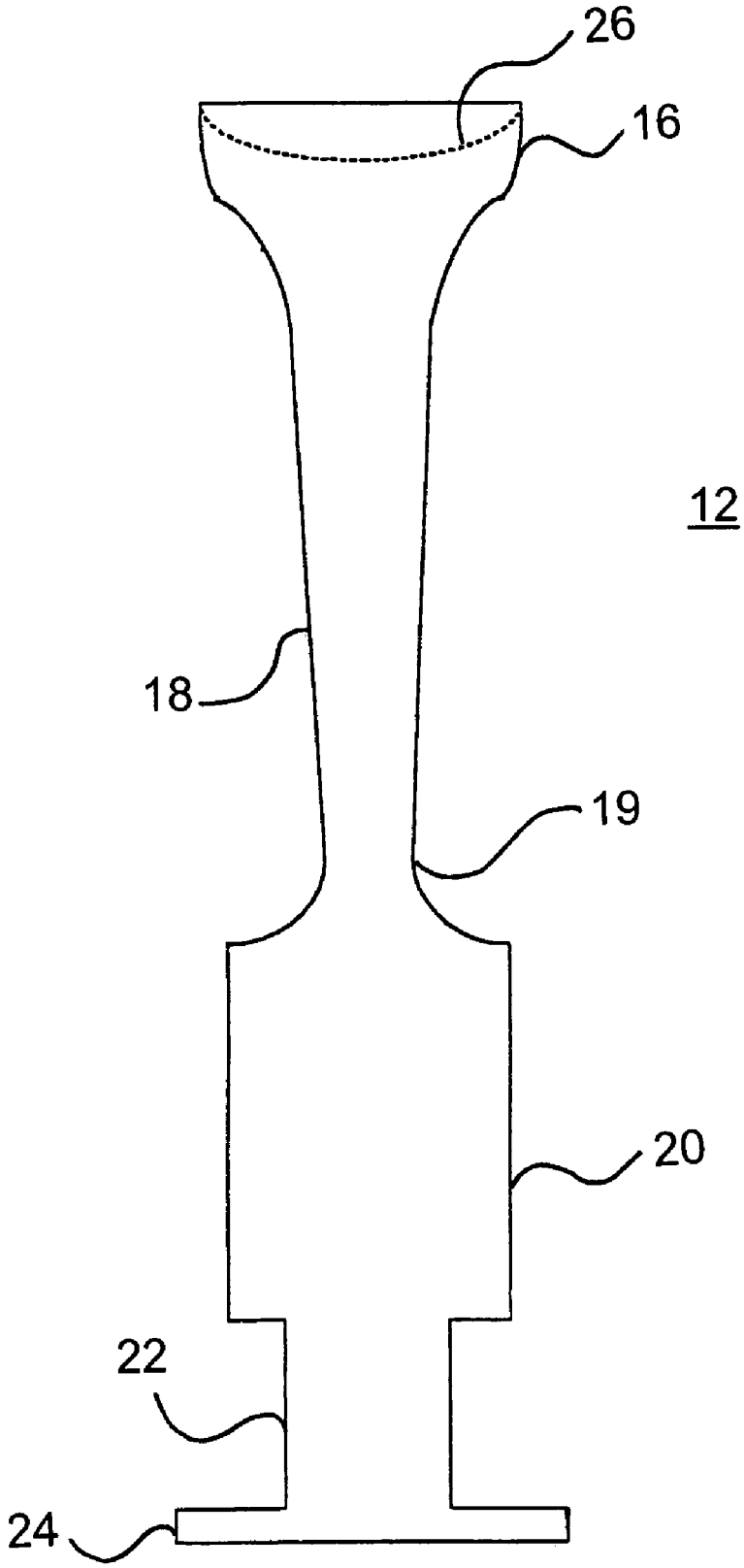
FIG. 5 is an elevation view of the flexible golf tee.
Figure 6:
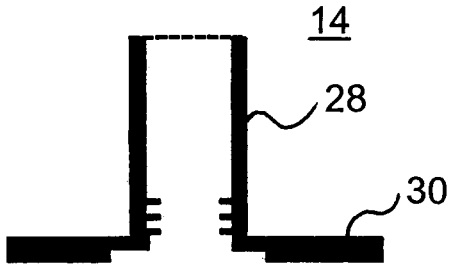
FIG. 6 is a cross-sectional view showing a rubber base according to the first embodiment.
Figure 7:
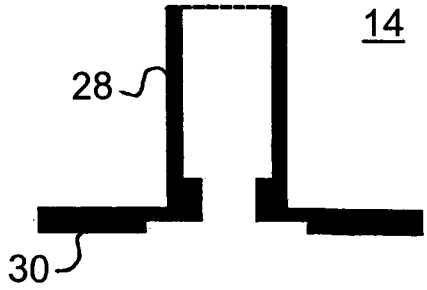
FIG. 7 is a cross-sectional view showing a rubber base according to the second embodiment.

As shown well in FIG. 5, the tee portion 12 includes a top disc 16, a neck portion 18, a body portion 20, a stem portion 22, and a bottom disc 24.

The top disc 16 includes a concave portion 26 that is adapted to support a golf ball. The neck portion 18 connects the top disc 16 and the body portion 20. The neck portion 18 has a diameter that is smaller than that of the body portion 20. The body portion 20 is substantially cylindrical. The stem portion 22 connects the body portion 20 and the bottom disc 24. The stem portion 22 has a diameter that is smaller than those of the body portion 20 and the bottom disc 24.

The neck portion 18 has the smallest diameter so that it is easily bent when the tee portion 12 is struck by a golf club. The diameter of the neck portion 18 changes gradually smaller from the top disc 16 and the body portion 20 and becomes smallest at a position 19 that is at a predetermined distance from the body portion 20 as shown well in FIG. 5. As shown well in FIG. 2, the tee portion 12 is bent at the position 19 at which the diameter of the neck portion 18 is smallest.

The stem portion 22 has a role of keeping the tee portion 12 and the base 14 in assembled state.

The top disc 16 has the same shape as that of a wooden tee that is widely used in the fairway. Therefore, it gives the same feeling as playing golf on the fairway. Only the slim tee portion 12 is visible above a driving range mat.

As shown in FIGS. 6 ~ 9, the base 14 includes a hollow body 28 and an annular flange 30 attached to the hollow body 28. The hollow body 28 is substantially cylindrical.

The hollow body 28 includes a first cylindrical portion 32 that receives the body portion 20 of the tee portion 12, and a second cylindrical portion 34 that receives the stem portion 22 of the tee portion 12. The inner diameter of the second cylindrical portion 34 is smaller than that of the first cylindrical portion 32.

Figure 9:
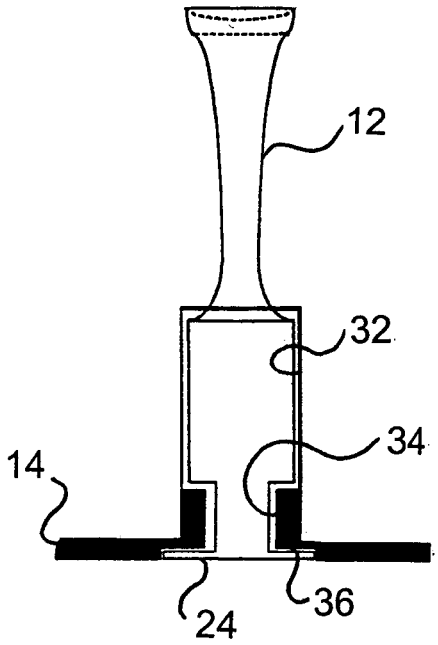
FIG. 9 is a cross-sectional view showing an assembled flexible golf tee with the rubber base according to the second embodiment.

In this way, as shown well in FIG. 9, the second cylindrical portion 34 of the base 14 interlocks with the stem portion 22 of the tee portion 12 between the body portion 20 and the bottom disc 24 of the tee portion 12 so that the tee portion 12 does not collapse into or fly out of the base 14, when the tee portion 12 is hit by a golf club.

The base 14 is more flexible than the tee portion 12.

As shown in FIG. 9, the annular flange 30 of the base 14 includes an annular recess 36 that receives the bottom disc 24 of the tee portion 12.

Figure 8:
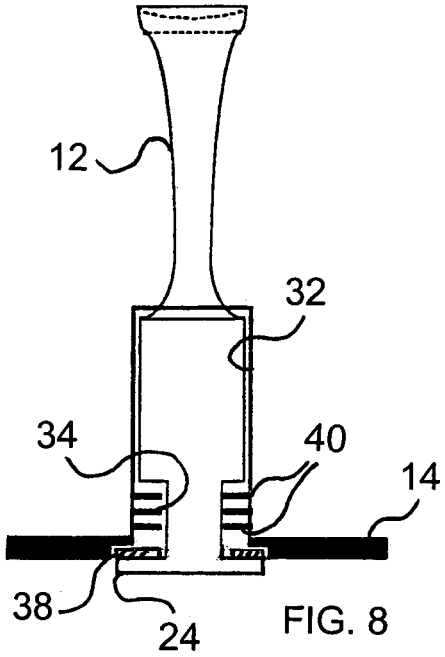
FIG. 8 is a cross-sectional view showing an assembled flexible golf tee with the rubber base according to the first embodiment.

As shown in FIG. 8, the flexible golf tee may further include a reinforcing washer 38. The reinforcing washer 38 is provided between the base 14 and the bottom disc 24 of the tee portion 12. The reinforcing washer 38 is made of Nylon and has a diameter of about 0.60 inch. In addition, the diameter of the bottom disc 24 is about 0.10 inch wider than the inside diameter of the base 14 for reinforcement.

In FIG. 8, the second cylindrical portion 34 of the base 14 includes three annular portions 40 that are spaced from one another.

The tee portion 12 is made of thermoplastic polyurethane elastomer material with high impact strength and low flexural modulus, and the base 14 is made of rubber. The material for the tee portion 12 also has high tensile elongation, high tear and impact strength.

The plastic tee portion 12 is provided in variety of colors including white, pink, yellow and wooden to help the eyes stay focused on a golf ball with a white rubber base 14. The rubber base 14 comes in just white because it stays under a driving range mat.

The plastic tee portion 12 and the rubber base 14 are both flexible to avoid breaking of them by the large size of a club head with strong power of swing.

FIG. 2 shows the bent state of the tee portion 12 in dotted line, and the upright state of the tee portion 12 in solid line.

FIG. 3 shows that the annular flange 30 of the base 14, and t

The bottom disc 24 of the tee portion 12 have circular shapes. The diameter of the annular flange 30 is about 2 inches. The shape of the bottom disc and the annular flange may be other shapes including a cross bar or a rectangle.

Figure 10:
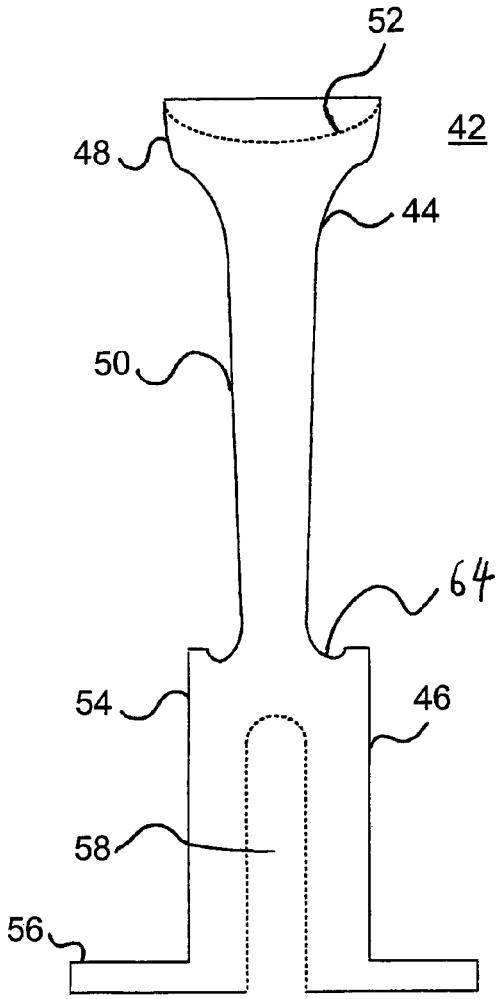
FIG. 10 is an elevation view of a flexible golf tee for an outdoor range, wherein the flexible golf tee does not have a separate rubber base.

As shown in FIG. 10, another embodiment of the present invention provides a flexible golf tee 42 that includes a substantially circular tee portion 44 that is adapted to support a golf ball, and a substantially circular base 46 that is integrally connected to the tee portion 44.

The tee portion 44 includes a top disc 48, and a neck portion 50. The top disc 48 includes a concave portion 52 that is adapted to support a golf ball. The neck portion 50 connects the top disc 48 and the base 46.

The base 46 includes a body 54 and an annular flange 56 attached to the body 54. The body 54 is substantially cylindrical. The body 54 includes an elongated hole 58 that is provided around the center of the body 54. The diameter of the annular flange 56 is about 1½ inch instead of the standard 2 inch size. The flexible golf tee 42 has a height up to about 3 inches.

The elongated hole 58 is provided to avoid plastic shrinking problem during post mold cooling due to the softness of the plastic material.

The neck portion 50 has a diameter, or cross-sectional area, which is smaller than those of the top disc 48 and the body of the base 46. Like the first embodiment, the diameter of the neck portion 50 becomes gradually smaller starting from the top disc 48 and the body 54, wherein the diameter of the neck portion 50 becomes smallest at a predetermined distance from the body 54.

The body 54 includes a circular notch 64 that is provided near the position where the body 54 is connected to the neck portion 50. The circular notch 64 helps to make the tee portion 44 appear as a regular wooden tee since it provides some depth beyond a point that the body 54 is hidden by a hole of a driving range mat. Also the circular notch 64 helps the neck portion 50 to bend while the body 54 is kept stationary in the driving range mat.

The flexible golf tee 42 is made a material having flexibility allowing the tee portion 44 to return to an upright position after the flexible golf tee 42 is hit by a golf club, and having strength to stably support a golf ball. The material requires a difficult combination of two different physical properties, that is, flexibility so that the tee is not fractured but bent in order to return to the upright position again, and strength to place and hold the golf ball. Also the material should give a feeling hard enough like a wooden golf tee so that a golfer should not have inconvenience in placing a golf ball, and should be flexible enough so that a golfer should feel little or no resistance when the club head hit the tee portion 44. Through extensive research and experiments, the applicant found a material having properties that satisfy such requirements.

The flexible golf tee is made of thermoplastic polyurethane elastomer, wherein the thermoplastic polyurethane elastomer has flexural modulus, which is measured per ASTM D790, ranging from about 9,000 to about 13,000 psi, Durometer Hardness, Shore A (+/−4), which is measured per ASTM D2240, ranging from about 70 A to 110 A, and ultimate tensile strength, which is measured per ASTM D412, ranging from 4500 to 7500 psi.

Figure 11:
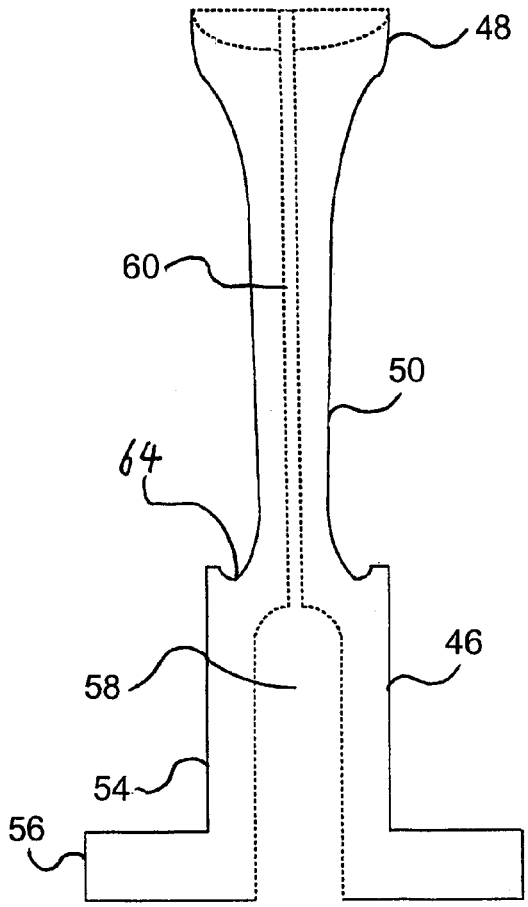
FIG. 11 is an elevation view of a flexible golf tee for an indoor range, wherein the flexible golf tee does not have a separate rubber base.

FIG. 11 shows another flexible golf tee 62, for which the tee portion 44 includes a through hole 60 that is provided around the center of the tee portion 44. The through hole 60 of the tee portion 44 is connected to the elongated hole 58 of the base 46. The through hole 60 is used to sense a light beam from the above of the flexible golf tee 62. The flexible golf tee 62 is mainly for indoor use. It is checked with the through hole 60 if there is a golf ball on the top disc 48. If there is a golf ball, then the flexible golf tee 62 is pushed up. If there is no golf ball on the top disc 48, then the flexible golf tee 62 comes down to wait another golf ball.

The flexible golf tees 10, 42 of the present invention are provided for use with a driving range mat. The flexible golf tees 10, 42 are simply plugged into a hole of a mat and held upright in the same way the conventional rubber tee is used.

Figure 4A:
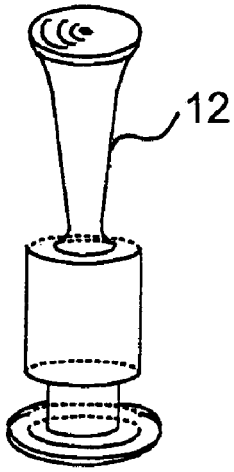
FIGS. 4(*a*), 4(*b*) and 4(*c*) show that the flexible golf tees are provided in three different heights.
Figure 4B:
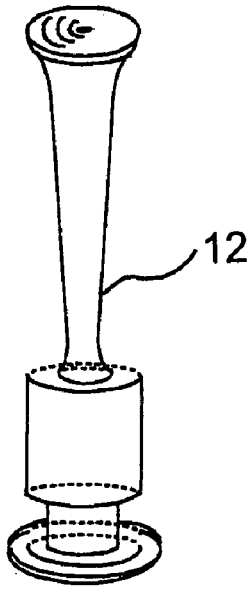
Figure 4C:
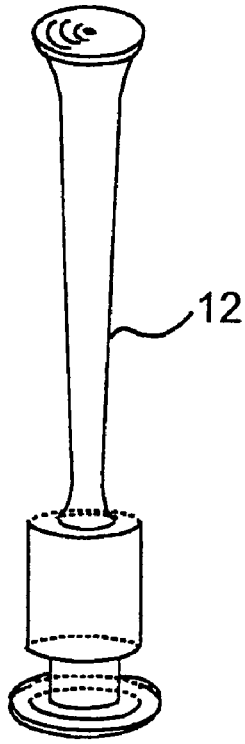

As shown in FIGS. 4(*a*), 4(*b*) and 4(*c*), the flexible golf tee 10 is available in three different sizes: 2 inches, 2½ inches or 3 inches. 2 inches or 1⅞ inches tall tees are for use with irons or 5 and 7 woods. 3 inches or 2⅞ inches tall tees are for use with the small face and large club head size of some woods.

The flexible golf tee of the present invention makes a golfer feel like playing on the fairway without the fear of a loose or flying tees or the trouble of stooping to bring the tee up after it is hit. A golfer can concentrate on the golf ball and hit it more consistently. The flexible golf tee will improve a golfer's performance and boot his or her confidence immediately because he or she can easily focus on the golf ball and hit it as if he or she plays golf on the fairway.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A flexible golf tee comprising:

a) a tee portion that is adapted to support a golf ball, wherein the tee portion is substantially circular; and b) a base;

wherein the tee portion comprises a top disc, and a neck portion, wherein the top disc comprises a concave portion that is adapted to support a golf ball, wherein the neck portion connects the top disc and the base, wherein the base comprises a body and a flange attached to the body, wherein the neck portion has a cross-sectional area that is smaller than those of the top disc and the body of the base;

wherein the flexible golf tee is made a material having flexibility allowing the tee portion to return to an upright position after the flexible golf tee is hit by a golf club, and having strength to stably support a golf ball, wherein the flexible golf tee is made of thermoplastic polyurethane elastomer, wherein the thermoplastic polyurethane elastomer has flexural modulus, which is measured per ASTM D790, ranging from about 9,000 to about 13,000 psi, Durometer Hardness, Shore A (+/−4), which is measured per ASTM D2240, ranging from about 70A to 110A, and ultimate tensile strength, which is measured per ASTM D412, ranging from 4500 to 7500 psi.

2. The flexible golf tee of claim 1, wherein the body is substantially cylindrical, wherein the body comprises an elongated hole that is provided around the center of the body, wherein the body comprises an arcuate notch that is provided near the position where the body is connected to the neck portion, wherein the diameter of the neck portion becomes gradually smaller starting from the top disc and the body, wherein the diameter of the neck portion becomes smallest at a predetermined distance from the body.

* * * * *